US010939797B2

(12) United States Patent
Yoo et al.

(10) Patent No.: US 10,939,797 B2
(45) Date of Patent: Mar. 9, 2021

(54) DISHWASHER

(71) Applicant: Samsung Electronics Co., Ltd., Suwon-si (KR)

(72) Inventors: Seung Wan Yoo, Suwon-si (KR); Buesing Johannes, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 473 days.

(21) Appl. No.: 15/616,076

(22) Filed: Jun. 7, 2017

(65) Prior Publication Data

US 2017/0354310 A1 Dec. 14, 2017

(30) Foreign Application Priority Data

Jun. 8, 2016 (KR) ..... 10-2016-0071063

(51) Int. Cl.

| | |
|---|---|
| ***A47L 15/42*** | (2006.01) |
| ***A47L 15/23*** | (2006.01) |
| *A47L 15/00* | (2006.01) |

(52) U.S. Cl.

CPC ..... *A47L 15/4278* (2013.01); *A47L 15/23* (2013.01); *A47L 15/0047* (2013.01); *A47L 15/428* (2013.01); *A47L 15/4214* (2013.01)

(58) Field of Classification Search

CPC ..... A47L 15/428; A47L 15/4278; A47L 15/23
See application file for complete search history.

(56) References Cited

U.S. PATENT DOCUMENTS

| | | | | |
|---|---|---|---|---|
| 3,362,645 | A | 1/1968 | Clark | |
| 7,753,062 | B2 * | 7/2010 | Burrows | A47L 15/23 134/198 |
| 8,210,191 | B2 * | 7/2012 | Gnadinger | A47L 15/4282 134/178 |
| 2008/0271759 | A1 * | 11/2008 | Burrows | A47L 15/23 134/25.2 |

(Continued)

FOREIGN PATENT DOCUMENTS

| | | |
|---|---|---|
| DE | 102011002938 | 7/2012 |
| DE | 102011081562 | 2/2013 |

(Continued)

OTHER PUBLICATIONS

Machine translation of DE-2011002938-A1, dated Jul. 2012. (Year: 2012).*

(Continued)

*Primary Examiner* — Joseph L. Perrin
*Assistant Examiner* — Kevin G Lee
(74) *Attorney, Agent, or Firm* — Staas & Halsey LLP

(57) ABSTRACT

The dishwasher includes a cabinet provided with a washing space inside thereof, and a nozzle unit for spraying washing water into the washing space. The nozzle unit includes a first unit body and a second unit body. Any one of the first and second unit bodies includes a first coupling rib formed along at least a portion of the periphery and a second coupling rib spaced apart from the first coupling rib by a predetermined distance. The other of the first and second unit bodies includes a third coupling rib inserted between the first and second coupling ribs and a second coupling rib located inside the third coupling rib, and stepped ribs configured to face each other.

16 Claims, 6 Drawing Sheets

(56) References Cited

U.S. PATENT DOCUMENTS

| | | | | |
|---|---|---|---|---|
| 2012/0325277 | A1 | 12/2012 | Mitchell et al. | |
| 2013/0255734 | A1* | 10/2013 | Hermann | A47L 15/4278 134/198 |
| 2014/0299683 | A1 | 10/2014 | Zhao et al. | |

FOREIGN PATENT DOCUMENTS

| | | |
|---|---|---|
| DE | 102012006379 | 10/2013 |
| EP | 0443662 | 8/1991 |
| JP | 2000-157478 | 6/2000 |
| KR | 1997-0003428 | 4/1997 |
| KR | 10-2009-0130884 | 12/2009 |
| KR | 10-2015-0142947 | 12/2015 |
| WO | 2015/144198 | 10/2015 |

OTHER PUBLICATIONS

Extended European Search Report dated Oct. 19, 2017 in European Patent Application No. 17174950.0.

* cited by examiner

DISHWASHER

CROSS-REFERENCE TO RELATED APPLICATIONS

This application claims the priority benefit of Korean Patent Application No. 10-2016-0071063, filed on Jun. 8, 2016, in the Korean Intellectual Property Office, the disclosure of which is incorporated herein by reference in its entirety.

BACKGROUND

1. Field

Embodiments of the present disclosure relate to a dishwasher, and more particularly to a dishwasher having improved cleaning efficiency.

2. Description of the Related Art

A dishwasher has a main body with a washing tub inside thereof, a basket for storing dishes, a sump for storing washing water, an injection nozzle for spraying washing water, and a pump for supplying washing water stored in the sump to the injection nozzle. The dishwasher is a household appliance that cleans tableware by spraying high pressure washing water to the tableware.

In general, a rotor type spraying structure with a rotating nozzle unit is applied to the dishwasher. The rotating nozzle unit injects washing water while rotating by water pressure.

The nozzle unit is rotated by the water pressure of the sprayed washing water while the washing water is sprayed to the washing space through the nozzle unit. In this process, if there is a foreign substance in the nozzle unit, or if the flow loss is large due to the gap between the parts of the nozzle unit, the rotational force of the nozzle unit is reduced, and the amount of washing water to be sprayed is also reduced.

As a result, the cleaning efficiency for the tableware placed in the washing space is reduced.

SUMMARY

Therefore, it is an aspect of the present disclosure to provide a dishwasher capable of reducing flow loss.

It is another aspect of the present disclosure to provide a dishwasher having an improved assembly structure.

It is still another aspect of the present disclosure to provide a dishwasher with improved spray efficiency.

Additional aspects of the present disclosure will be set forth in part in the description which follows and, in part, will be apparent from the description, or may be learned by practice of the disclosure.

In accordance with an aspect of the present disclosure, a dishwasher includes a cabinet provided with a washing space inside and a nozzle unit for spraying washing water into the washing space. The nozzle unit includes a unit body having a first unit body and a second unit body coupled to the first unit body and forming an inner space through which the wash water flows between the first unit body. Any one of the first and second unit bodies includes a first coupling rib formed along at least a portion of the periphery and a second coupling rib spaced apart from the first coupling rib in a radially outward direction, and the other one of the first and second unit bodies includes a third coupling rib inserted between the first and second coupling ribs and a stepped rib located inside the third coupling rib, and having an end facing an end of the first coupling rib.

The first coupling rib and the stepped rib may be configured to abut one another.

An end of the first coupling rib and an end of the stepped rib may be disposed inside the third coupling rib.

The second coupling rib may protrude more than the first coupling rib in any of the unit bodies.

The third coupling rib may protrude more than the stepped rib in the other unit body.

At least one coupling rib of the first to third coupling ribs may be provided such that an end thereof is in contact with one unit body facing the end thereof, between the first and second unit bodies.

The unit body may include a first inner surface of the first unit body and a second inner surface facing the first inner surface of the second unit body. The first coupling rib and the stepped rib may protrude from the first and second inner surfaces, respectively.

The unit body may include a first rounding portion formed between the first inner surface and the first coupling rib and a second rounding portion formed between the second inner surface and the stepped rib.

The nozzle unit may be rotatably provided. The nozzle unit may include first and second injection holes formed in the unit body and through which washing water flowing through the first and second paths are respectively injected and at least one guide rib for partitioning the first and second paths, and having a narrower width in the downstream than in the upstream.

The at least one guide rib is formed such that at least a part of the guide rib is inclined in an injection direction of the first and second injection holes.

The at least one guide rib extends to the first and second injection holes.

In accordance with another aspect of the present disclosure, a dishwasher includes a cabinet provided with a washing tub and a nozzle unit for spraying wash water into the washing tub. The nozzle unit includes a first unit body having at least two first coupling ribs spaced apart from each other; and a second unit body having at least one second coupling rib inserted alternately with the at least two first coupling ribs and forming a washing water flow space inside the at least two first unit bodies, by coupling to the at least two first coupling ribs. The second unit body includes a stepped rib protruding to face an end of the innermost coupling rib among the at least two first coupling ribs.

The end of the innermost coupling rib among the at least two first coupling ribs and an end of the stepped rib may be configured to abut one another.

The end of the innermost coupling rib among the at least two first coupling ribs and the end of the stepped rib may be disposed on a side of the second coupling rib.

The first unit body may be provided with a first inner surface forming one side of the flow space. The second unit body may be provided with a second inner surface facing the first inner surface and forming the other side of the flow space. The end of the innermost coupling rib among the at least two first coupling ribs and the end of the stepped rib may protrude from the first and second inner ribs.

The unit body may include a first rounding portion formed in a curved surface between the first inner surface and the first coupling rib and a second rounding portion formed in a curved surface between the second inner surface and the stepped rib.

In accordance with another aspect of the present disclosure, a dishwasher includes a cabinet provided with a washing space inside and a nozzle unit provided rotatably for spraying washing water into the washing space. The nozzle unit includes a unit body having an injection hole through which wash water flowing through the internal path is injected and a plurality of guide ribs forming the path, and configured to narrow the width of the path in the downstream than the upstream of the path.

The guide rib may be formed such that at least a part of the guide rib is inclined in an injection direction of the washing water in the injection hole.

The guide rib extends to the injection hole.

The first injection hole is formed radially with respect to the rotation center of the nozzle unit. The second injection hole is configured to allow the washing water to be sprayed in a circumferential direction with respect to a rotation center of the nozzle unit.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION

Figure 1:
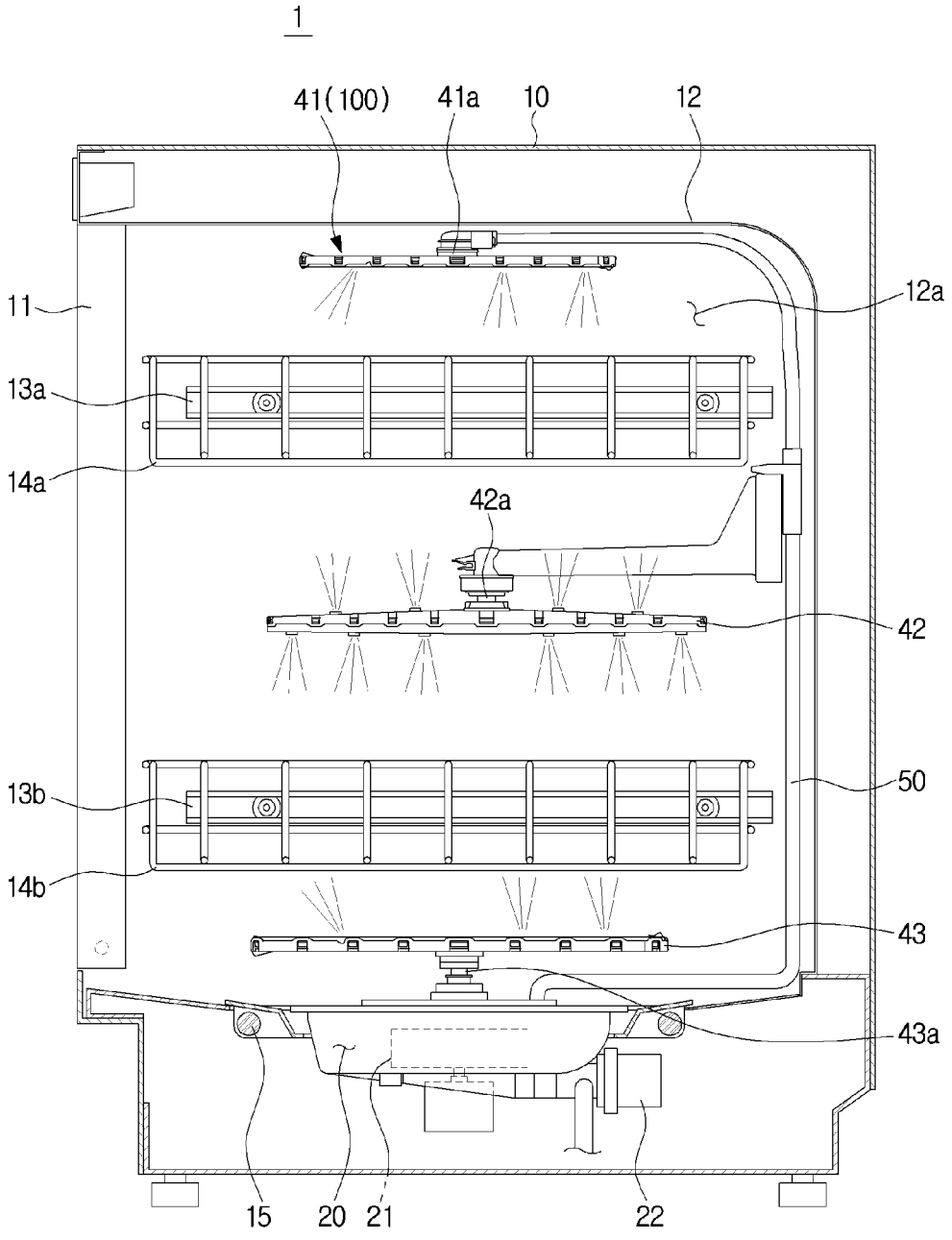
FIG. 1 is a diagram of a dishwasher according to an embodiment of the present disclosure.

The embodiments described in this specification and configurations illustrated in drawings are only exemplary embodiments and do not represent the overall technological scope of the disclosure, and it is to be understood that the disclosure covers various equivalents, modifications, and substitutions at the time of filing of this application.

Also, throughout the entire specification, the same reference numerals refer to the same components or elements to serve the same function.

Also, the terminology used herein is for the purpose of describing particular embodiments only and is not intended to be limiting of the present disclosure. Also, as used herein, the singular forms "a," "an," and "the," are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Also, it will be understood that, although the terms including ordinal numbers such as "first," "second," etc. may be used herein to describe various elements, these elements are not limited by these terms. These terms are only used to distinguish one element from another. For example, a second element could be termed a first element without departing from the teachings of the present disclosure, and similarly a first element could be also termed a second element. The term "and/or" includes any and all combinations of one or more of the associated, listed items. Hereinafter, embodiments according to the present disclosure will be described in detail with reference to the accompanying drawings.

Hereinafter, embodiments according to the present disclosure will be described in detail with reference to the accompanying drawings.

A dishwasher 1 includes a cabinet 10 forming an outer appearance, a washing tub 12 provided inside the cabinet 10, a dish basket 14*a*, and 14*b*, a sump 20 for collecting and storing wash water, and an injection unit 41, 42, and 43 for spraying wash water.

The washing tub 12 is provided in a substantially box shape and has a front face opened to allow the dishware to be put in and out. The open front of the washing tub 12 may be opened and closed by a door 11. The door 11 may be rotatably coupled to the cabinet 10. Washing water is injected into the washing tub 12 to form a washing space 12*a* in which the dishes can be washed.

The dish baskets 14*a* and 14*b* may include an upper dish basket 14*a* and a lower dish basket 14*b*. The upper dish basket 14*a* may be supported by an upper rack 13*a* and the lower dish basket 14*b* may be supported by a lower rack 13*b*. The upper rack 13*a* and the lower rack 13*b* may be slidable forward and backward in the washing tub 12.

The sump 20 may be provided with a washing pump 21 for pumping the stored water to the injection unit 41, 42, and 43. The washing water pumped by the washing pump 21 may be supplied to the first to third injection units 41, 42 and 43 through a supply pipe 50.

In addition, a heater 15 for heating the washing water and a drainage pump 22 for draining the washing water may be provided under the washing tub 12.

Meanwhile, as shown in FIG. 1, the first injection unit 41 may be provided above the upper dish basket 14*a*. The second injection unit 42 may be provided between the upper dish basket 14*a* and the lower dish basket 14*b*. The third injection unit 43 may be provided under the lower dish basket 14*b*.

The first injection unit 41 may rotate about a rotation axis 41*a* and the second injection unit 42 may rotate around a rotation axis 42*a*. The third injection unit 43 may be provided to rotate around a rotation axis 43*a*.

The first injection unit 41 may spray the washing water toward the tableware stored in the upper dish basket 14*a* and the second injection unit 42 may spray the washing water toward the tableware stored in the upper dish basket 14*a* and the lower dish basket 14*b*. The washing water may be sprayed toward the tableware. In addition, the third injection unit 43 may spray the washing water toward the tableware accommodated in the lower dish basket 14*b*.

Figure 2:
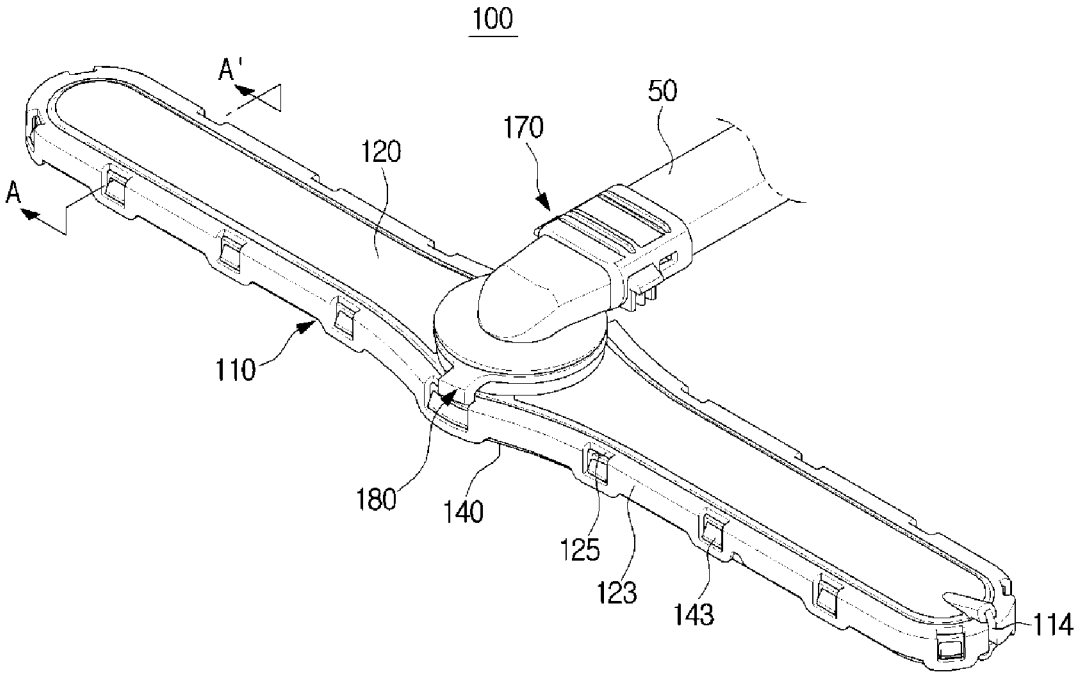
FIG. 2 is a perspective view of a nozzle unit of the dishwasher according to an embodiment of the present disclosure.
Figure 3:
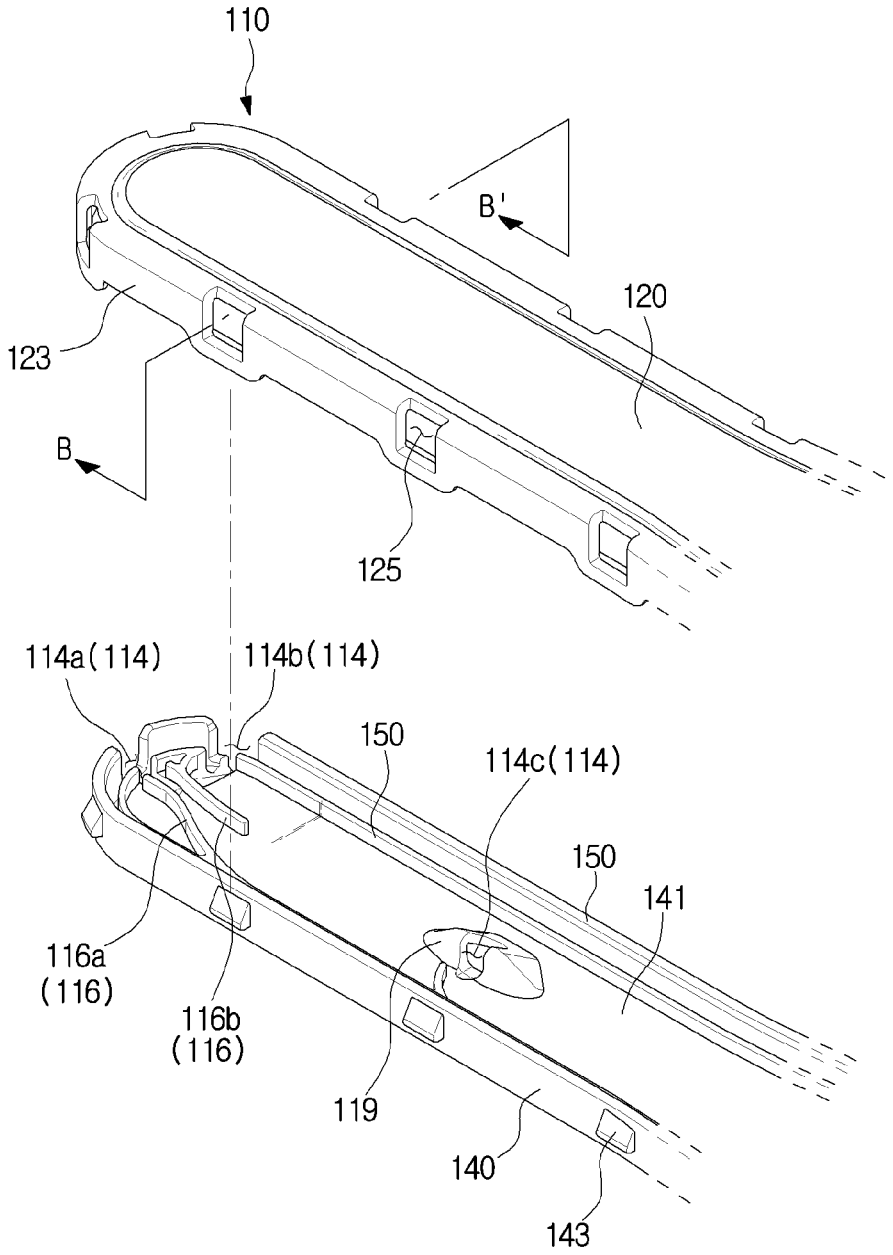
FIG. 3 is an exploded perspective view of the nozzle unit of the dishwasher according to an embodiment of the present disclosure.
Figure 4:
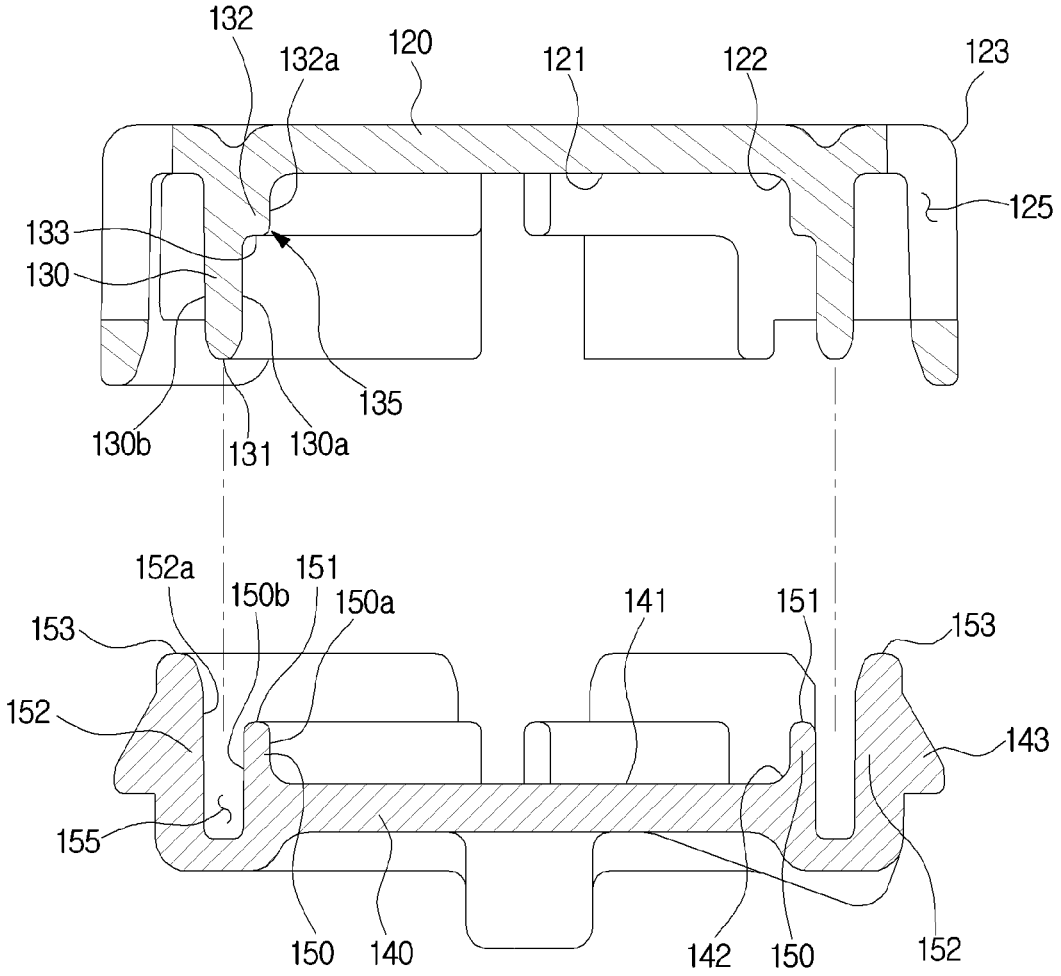
FIG. 4 is a sectional view taken along the line B-B' in FIG. 3.
Figure 5:
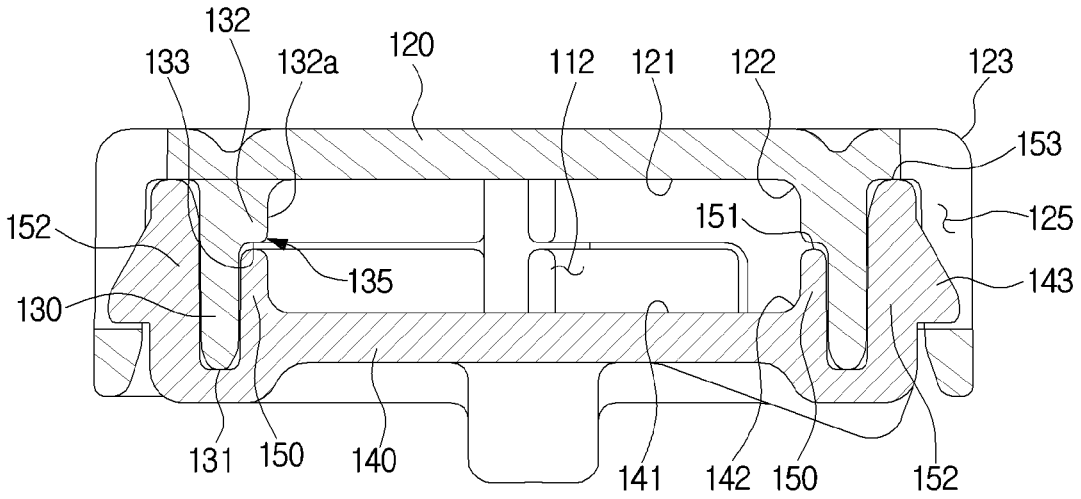
FIG. 5 is a cross-sectional view taken along line A-A' in FIG. 2.

FIG. 2 is a perspective view of a nozzle unit of a dishwasher according to an embodiment of the present disclosure. FIG. 3 is an exploded perspective view of the nozzle unit of the dishwasher according to an embodiment of the present disclosure. FIG. 4 is a sectional view taken along the line B-B' in FIG. 3. FIG. 5 is a cross-sectional view taken along line A-A' in FIG. 2.

A nozzle unit 100 is configured to spray wash water into the washing space 12*a* in the washing tub 12. The nozzle unit 100 is the first injection unit 41 among the first to third injection units 41, 42 and 43 described above, but is not limited thereto. The nozzle unit 100 may be the second or the third injection unit.

The nozzle unit 100 is provided to receive wash water from the supply pipe 50 and inject the wash water into the washing tub 12. The nozzle unit 100 may be rotatably provided. In detail, the nozzle unit 100 may be rotatably provided by the rotational force of the water pressure of the washing water discharged into an injection hole 114 formed in the nozzle unit 100.

The nozzle unit 100 may include a unit body 110 and a rotation holder 180. The rotation holder 180 is rotatably disposed on the supply pipe 50 and is provided to be coupled to the unit body 110. In detail, the supply pipe 50 includes a connection portion 170 configured to allow the nozzle unit 100 to be rotatably coupled. The rotation holder 180 is rotatably provided at the connection portion 170. The unit body 110 is provided to rotate relative to the supply pipe by rotation of the rotation holder 180.

The unit body 110 is rotatably connected to the supply pipe 50 together with the rotation holder 180. At least one injection hole 114 is provided in the unit body 110 and the washing water supplied from the supply pipe is injected into the washing space 12*a* through the at least one injection hole 114.

The unit body 110 may include an upper body 120 and a lower body 140. The upper body 120 and the lower body 140 are provided so as to be coupled to each other in an up and down direction and are provided to form an inner space 112 (see FIG. 5) through which wash water supplied from the supply pipe flows.

A coupling flange 123 having a plurality of coupling grooves 125 may be formed around the upper body 120. A plurality of coupling protrusions 143 formed to be inserted into the plurality of coupling grooves 125 may be formed around the lower body 140. The plurality of coupling protrusions 143 of the lower body 140 are inserted into the plurality of coupling grooves 125 of the upper body 120 so that the upper and lower bodies 120 and 140 can be engaged with each other. However, the present disclosure is not limited thereto, and a coupling flange 123 having a plurality of coupling grooves 125 formed in the lower body 140 may be formed. Also, a plurality of coupling protrusions 143 may be formed on the upper body 120.

The unit body 110 may include a plurality of coupling ribs. The plurality of coupling ribs may be formed along at least a portion of the unit body 110. In this embodiment, the plurality of coupling ribs is formed at a portion of the unit body 110 excluding at least one injection hole 114, so that the unit body 110 is coupled thereto or the inside of the unit body 110 is closed.

The lower body 140 may include first and second coupling ribs 150 and 152. The first coupling ribs 150 are formed along the periphery of at least a portion of the lower body 140 and the second coupling ribs 152 are spaced apart from the first coupling ribs 150 at a certain interval in the outward direction. The first and second coupling ribs 150 and 152 are configured to protrude upward from the lower body 140. The first and second coupling ribs 150 and 152 may form an insertion groove 155 (see FIG. 4) as a spaced space therebetween so that a third coupling rib 130 described later can be inserted.

The upper body 120 may include the third coupling rib 130. The third coupling rib 130 is formed along at least a portion of the upper body 120 and may be inserted between the first and second coupling ribs described above. That is, the third coupling rib 130 may be inserted into the insertion groove 155 formed by the first and second coupling ribs 150 and 152. The first to third coupling ribs 130, 150 and 152 are arranged alternately so that the inner space 112 can be sealed in an overlapped manner.

The insertion groove 155 formed between the first and second coupling ribs 150 and 152 may be smaller than the thickness of the third coupling rib 130. The third coupling rib 130 is inserted into the insertion groove 155 and is fitted between the first and second coupling ribs 150 and 152. Since the thickness of the third coupling rib 130 is larger than the width of the insertion groove 155, the first to third coupling ribs 130, 150 and 152 can be coupled to each other in a close contact with each other.

The third coupling rib 130 is inserted between the first and second coupling ribs 150 and 152 so that the sides of the first and second coupling ribs 150 and 152 and the sides of the third coupling rib 130 are contact with each other. That is, at least one of an inner side surface 130*a* and an outer side surface 130*b* of the third coupling rib 130 is in contact with side surfaces 152*a* and 150*b* of the first and second coupling ribs 150 and 152. As a result, the sealing of the inside of the unit body 110 can be improved by the surface contact between the coupling ribs 130, 150 and 152.

The upper body 120 may include a stepped rib 132. The stepped rib 132 is configured such that its end in the length direction faces the end of the first coupling rib 150. That is, the first coupling rib 150 and the stepped rib 132 can prevent the concave portion from being formed in the inner space 112 of the unit body 110. That is, it is possible to prevent the path resistance from becoming large due to the occurrence of concave or convex portions in the inner space 112 of the unit body 110. The stepped rib 132 may function as a sidewall forming the inner space 112 with the first coupling rib 150 to reduce the flow resistance of the wash water flowing through the inner space 112. The ends of the first coupling ribs 150 and the stepped ribs 132 may be configured to face each other and be configured to be in contact with each other.

For convenience of explanation, a portion formed between the first coupling rib 150 and the stepped rib 132 may be referred to as a first portion 135. The first portion 135 may be a portion where the first coupling rib 150 and the stepped rib 132 abut. The first portion 135 may be a spaced apart portion when the first coupling rib 150 and the stepped rib 132 are separated from each other by a predetermined distance.

The first portion 135 may be located inside the third coupling rib 130. That is, the end of each of the first coupling rib 150 and the stepped rib 132 may be located inside the third coupling rib 130. When the wash water flows into the inner space 112, the pressing force by the water pressure of the wash water is concentrated in the first portion 135. The outer surface 130*b* of the third coupling rib 130 and the inner surface 152*a* of the second coupling rib 152 can be brought into closer contact with each other by the pressing force concentrated on the first portion 135. Through this process, the inner space 112 can be further sealed.

An inner surface 150*a* of the first coupling rib 150 and an inner surface 132*a* of the stepped rib 132 may be provided on the same extension line. That is, each inner side of the first coupling rib 150 and the stepped rib 132 may be formed in parallel. The first coupling ribs 150 and the stepped ribs 132 forming the side walls of the inner space 112 are not stepped so that the flow resistance of the washing water can be reduced.

The second coupling rib 152 may be formed to protrude further from the lower body 140 than the first coupling rib 150 and the third coupling rib 130 may protrude further from the upper body 120 than the stepped rib 132. With this configuration, the pressing force of the washing water by the water pressure can be dispersed by the plurality of coupling ribs, and furthermore, the contact area between the plurality of coupling ribs can be widened so that the inner space 112 can be sealed in a superimposed manner.

At least one coupling rib of the first to third coupling ribs 130, 150 and 152 may be provided such that the end of the coupling rib contacts a unit body facing the coupling rib, between the upper and lower bodies 120 and 140. At least one of the upper surfaces 131, 151, and 153 of the first to third coupling ribs 130, 150, and 152 may be in contact with the unit body 110 facing the upper surface. The coupling ribs contact the facing unit body 110 to prevent the wash water flowing in the inner space 112 from leaking to the outside. That is, the first to third coupling ribs 130, 150, and 152 can contact each other at their side surfaces. Also, the ends of the coupling ribs 130, 150 and 152 may contact the unit body 110, facing the ends of the coupling ribs 130, 150 and 152, thereby improving the tightness of the inner space 112.

For convenience of description, it is assumed that the lower body 140 is provided with the first and second coupling ribs 150 and 152 and the upper body 120 is provided with the third coupling rib 130 and the stepped rib 132 but is not limited thereto. In other words, the upper body 120 may be provided with the first and second coupling ribs 150 and 152, and the lower body 140 may be provided with the third coupling rib 130 and the stepped rib 132. The number of coupling ribs is not limited thereto. At least two coupling ribs for forming at least one insertion groove 155 in the unit body 110 of one of the upper body 120 and the lower body 140 are provided, and at least one coupling rib inserted into at least one insertion groove 155 may be provided in the other unit body 110

The first coupling rib 150 and the stepped rib 132 may protrude from the lower body 140 and the upper body 120, respectively. That is, the upper and lower boundaries of the inner space 112 may be formed by a lower inner surface 141 of the lower body 140 and an upper inner surface 121 of the upper body 120. In this case, the points where the ends of the stepped ribs 132 and the first coupling ribs 150 face each other can protrude from the upper inner surface 121 and the lower inner surface 141, respectively. Also, the point where the end of the stepped rib 132 faces the first coupling rib 150 may be positioned between the upper inner surface 121 and the lower inner surface 141. That is, the first portion 135 may be spaced apart from the lower inner surface 141 and the upper inner surface 121.

The unit body 110 may include first and second rounding portions 122 and 142.

The first rounding portion 142 may be formed between the lower inner surface 141 and the first coupling rib 150. The first rounding portion 142 may be formed along the inside of the first coupling rib 150.

The second rounding portion 122 may be formed between the upper inner surface 121 and the stepped rib 132. The second rounding portion 122 may be formed along the inside of the stepped rib 132. The first rounding portion 142 connects the inner side surface and the lower inner surface 141 of the first coupling rib 150 and the second rounding portion 122 connects the inner side surface of the stepped rib 132 and the upper inner surface 121. The first rounding portion 142 and the second rounding portion 122 may be curved. The first and second rounding portions 122 and 142 reduce the flow resistance of the wash water flowing in the inner space 112 to improve the injection efficiency of the wash water injected from the unit body 110.

Figure 6:
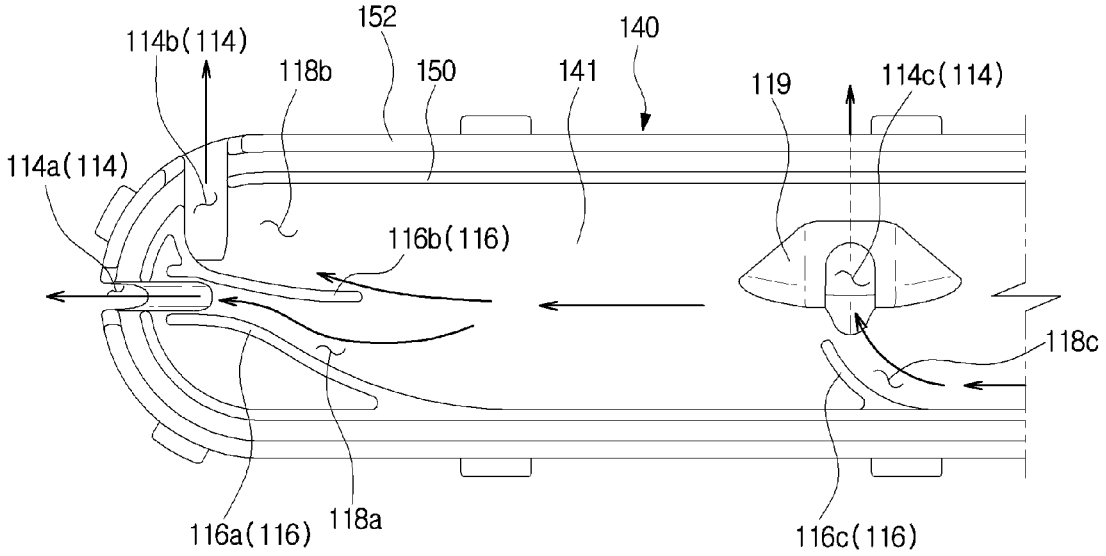
FIG. 6 is a front view of an inner structure of the nozzle unit of the dishwasher according to an embodiment of the present disclosure.

FIG. 6 is a front view of the inner structure of the nozzle unit of the dishwasher according to an embodiment of the present disclosure.

The unit body 110 may include at least one guide rib 116. The at least one guide rib 116 is formed in the interior of the unit body 110 to guide the flow of the wash water so that wash water flowing through the inner space 112 can be discharged through the injection hole 114.

The guide ribs 116 are provided to guide the flow of wash water within the unit body 110. The guide ribs 116 may be configured to extend to the corresponding injection holes 114 in the interior of the unit body 110.

At least one part of the guide ribs 116 are formed to be inclined in the direction of spraying the wash water, so that the flow of the wash water can be guided to the injection holes 114. Also, the guide ribs 116 divide the paths through which the washing water flows, and the washing water flowing through any one of the paths can be discharged to the outside of the nozzle unit 100 through the corresponding injection hole 114.

The guide ribs 116 are configured to narrow the width of the path of the downstream than the upstream in the inner space 112 of the unit body 110. That is, the adjacent guide ribs 116 are configured to be narrower in the width therebetween in the downstream than the upstream. With this configuration, the flow of the washing water can be concentrated in the injection hole 114 and the injection force in the injection hole 114 can be improved.

The guide ribs 116 are arranged to traverse the inner space 112 to define a path formed in the inner space 112. That is, the guide ribs 116 protruding from the upper inner surface 121 and the guide ribs 116 protruding from the lower inner surface 141 are arranged to be opposed to each other and particularly to be in contact with each other. The guide ribs 116 are protruded from the inner surface of one of the first and second unit bodies 110 to the inner surface of the other unit body 110

For convenience of explanation, in this embodiment, the unit body 110 may include a first injection hole 114*a* and a second injection hole 114*b*. The first injection hole 114*a* may be formed radially with respect to the rotation center of the unit body 110. The second injection hole 114*b* may be spaced apart from the first injection hole 114*a* and disposed on the side of the unit body 110. In the unit body 110, the washing water flows through the first and second injection holes 114 through the first and second paths. The second injection hole 114*b* is disposed on the side of the unit body 110 so that the unit body 110 can be rotated by the spraying force of the washing water discharged into the second injection hole 114*b*.

For convenience of explanation, the unit body 110 may include first and second guide ribs 116*a* and 116*b* corresponding to the first and second injection holes 114*a* and 114*b*. The first and second guide ribs 116*a* and 116*b* divide the flow path into the first and second paths 118*a* and 118*b* and the wash water may be provided to flow into the first and second injection holes 114*a* and 114*b*. At least a portion of the first and second guide ribs 116*a* and 116*b* are formed to be inclined in the injection direction of the first and second injection holes 114*a* and 114*b* so that the flow of the wash water is transmitted through the first and second injection holes 114*a* and 114*b*.

The second guide rib 116*b* can guide the washing water in the inner space 112 so that the unit body 110 can be rotated by the spraying force of the washing water discharged to the second injection hole 114*b*. That is, the second guide rib 116*b* is inclined in a direction opposite to the rotating direction of the unit body 110 so that the spraying force of the washing water discharged through the second injection hole 114*b* affects the rotation of the unit body 110.

The first guide rib 116*a* is provided to form one side of the first path 118*a*. The second guide rib 116*b* is provided to partition the first and second paths. Also, the second guide rib 116*b* is formed such that one side thereof forms the other side of the first path 118*a*, and the other side thereof forms one side of the second path 118*b*. The other side of the second path 118*b* may be formed by the inner surface of the unit body 110 according to the embodiment. In detail, the other side of the second path 118*b* may be formed by the inner surface 132*a* of the stepped rib 132 and the inner surface 150*a* of the first coupling rib 150. However, the present disclosure is not limited to this, and the other side of the second path 118*b* may be formed by adding a separate guide rib.

The first and second guide ribs 116*a* and 116*b* may be configured such that the width of the first path 118*a* is narrower in the downstream than the upstream side. The second guide rib 116*b* and the inner side 150*a* of the first coupling rib 150 may be configured to narrow the width of the second path 118*b* in the downstream than the upstream. With this configuration, the washing water can be concentrated into the first and second injection holes 114*a* and 114*b*. Also, the spraying force of the washing water discharged through the first and second injection holes 114*a* and 114*b* can be improved. The unit body 110 may include a third injection hole 114*c*. The third injection hole 114*c* may be formed on the bottom surface of the unit body 110. In detail, the third injection hole 114*c* may be formed in the lower body 140 of the unit body 110, and may be provided to penetrate the lower inner surface 141 to the outside. At least one third injection hole 114*c* may be provided. In this embodiment, three third injection holes 114*c* are provided.

The unit body 110 may include a guide projection 119 provided adjacent to the third injection hole 114*c* and guiding the wash water toward the third injection hole 114*c*. A pair of guide projections 119 are provided and may be disposed on both sides of the third injection hole 114*c*. The guide projection 119 may be formed to protrude from the lower inner surface 141.

The unit body 110 may include a third guide rib 116*c* corresponding to the third injection hole 114*c*. The third guide rib 116*c* is provided to form a third path 118*c*. At least a portion of the third guide rib 116*c* may be inclined in the injection direction of the third injection hole 114*c* to guide the flow of the wash water to the third injection hole 114*c*.

The third guide rib 116*c* can guide the washing water in the inner space 112 so that the unit body 110 can rotate by the spraying force of the washing water discharged into the third injection hole 114*c*. That is, the third guide rib 116*c* is inclined in a direction opposite to the rotation direction of the unit body 110 so that the spraying force of the washing water discharged through the third injection hole 114*c* affects the rotation of the unit body 110. The third guide rib 116*c* may be branched from the first coupling rib 150 and extended.

As is apparent from the above description, according to the proposed dishwasher, the sealing structure of the nozzle unit is implemented, and the flow loss can be reduced.

It is also possible to improve the flow efficiency of the washing water by reducing the path resistance inside the nozzle unit.

In addition, the guide rib is provided inside the nozzle unit to improve the straightness and injection efficiency of the washing water sprayed from the nozzle unit.

The present disclosure has been described in detail with reference to the exemplary embodiments. However, the exemplary embodiments should be considered in a descriptive sense only, and the disclosure is not limited thereto. It will be apparent to those skilled in the art that various modifications and improvements within the scope of the disclosure may be made.

What is claimed is:

1. A dishwasher comprising:

a cabinet including a washing compartment provided at an inside of the cabinet; and a nozzle assembly configured to spray water into the washing compartment, and including a first assembly body and a second assembly body coupled to the first assembly body in a first direction to form a path for the water to flow in the nozzle assembly, wherein the first assembly body comprises:

a first coupling rib; and a second coupling rib provided outside the first coupling rib relative to a center of the first assembly body; and at least one coupling protrusion provided on an outside of the second coupling rib relative to the center of the first assembly body, and wherein the second assembly body comprises:

a third coupling rib inserted between the first coupling rib and the second coupling rib;

a stepped rib located inside the third coupling rib relative to a center of the second assembly body, and at an opposing position along the first direction to the first coupling rib, such that an end of the stepped rib along the first direction faces an end of the first coupling rib along the first direction; and a coupling flange provided outside the third coupling rib relative to the center of the second assembly body, and including at least one coupling groove provided to receive the at least one coupling protrusion.

2. The dishwasher of claim 1, wherein the end of the first coupling rib is configured to contact the end of the stepped rib.

3. The dishwasher of claim 2, wherein the end of the first coupling rib and the end of the stepped rib are disposed inside the third coupling rib relative to the center of the second assembly body.

4. The dishwasher of claim 1, wherein the second coupling rib protrudes more than the first coupling rib.

5. The dishwasher of claim 1, wherein the third coupling rib protrudes more than the stepped rib.

6. The dishwasher of claim 1, wherein an end of at least one of the second coupling rib and the third coupling rib is configured to contact a respective one of the first assembly body and the second assembly body.

7. The dishwasher of claim 1, wherein the first assembly body further includes a first inner surface and the second assembly body further includes a second inner surface, and wherein the first coupling rib protrudes from the first inner surface, and the stepped rib protrudes from the second inner surface.

8. The dishwasher of claim 7, wherein the first assembly body further includes:

a first rounding portion formed between the first inner surface and the first coupling rib; and the second assembly body further includes:

a second rounding portion formed between the second inner surface and the stepped rib.

9. The dishwasher of claim 1, wherein the nozzle assembly is configured to be rotatable, and wherein the nozzle assembly further includes:

first and second injection holes through which the water is sprayed; and at least one guide rib partitioning a path of the water to the first and second injection holes in to a first path and a second path, and forming a narrower width of each of the first path and the second path in a downstream direction of the first path and the second path.

10. The dishwasher of claim 9, wherein the at least one guide rib is formed such that at least a part of the guide rib is inclined in an injection direction of the first and second injection holes.

11. The dishwasher of claim 9, wherein the at least one guide rib extends to the first and second injection holes.

12. A dishwasher comprising:

a cabinet including a washing tub; and a nozzle assembly configured to spray water into the washing tub, wherein the nozzle assembly comprises:

a first assembly body having a first coupling rib, a second coupling rib spaced apart from the first coupling rib, and at least one coupling protrusion provided on an outside of the second coupling rib relative to the center of the first assembly body; and a second assembly body having a third coupling rib configured to be inserted between the first coupling rib and the second coupling rib in a first direction, to form a water flow path inside the first assembly body and the second assembly, wherein the second assembly body further comprises:

a stepped rib located inside the third coupling rib relative to a center of the second assembly body, and at an opposing position along the first direction to an innermost coupling rib, relative to a center of the first assembly body, among the first coupling rib and the second coupling rib, such that an end of the stepped rib along the first direction faces an end of the innermost coupling rib along the first direction, and a coupling flange provided outside the third coupling rib relative to the center of the second assembly body, and including at least one coupling groove provided to receive the at least one coupling protrusion.

13. The dishwasher of claim 12, wherein the end of the innermost coupling rib is configured to contact the end of the stepped rib.

14. The dishwasher of claim 13, wherein the end of the innermost coupling rib and the end of the stepped rib are disposed on a side of the third coupling rib.

15. The dishwasher of claim 12, wherein the first assembly body further includes a first inner surface forming one side of the water flow path, wherein the second assembly body further includes a second inner surface facing the first inner surface and forming an opposing side of the water flow path, and wherein the innermost coupling rib and the stepped rib protrude less than the first and third inner ribs.

16. The dishwasher of claim 15, wherein the first assembly body further includes:

a first rounding portion formed in a curved surface between the first inner surface and the first coupling rib; and the second assembly body further includes:

a second rounding portion formed in a curved surface between the second inner surface and the stepped rib.

* * * * *